US009410522B2

(12) United States Patent
Rochas

(10) Patent No.: US 9,410,522 B2
(45) Date of Patent: Aug. 9, 2016

(54) PRESSURE CONTROL VALVE

(71) Applicant: Robert Bosch GmbH, Stuttgart (DE)

(72) Inventor: Pierre-Marie Rochas, Villeurbanne (FR)

(73) Assignee: Robert Bosch GmbH, Stuttgart (DE)

( * ) Notice: Subject to any disclaimer, the term of this patent is extended or adjusted under 35 U.S.C. 154(b) by 74 days.

(21) Appl. No.: 14/406,245

(22) PCT Filed: May 7, 2013

(86) PCT No.: PCT/EP2013/059518

§ 371 (c)(1),
(2) Date: Dec. 8, 2014

(87) PCT Pub. No.: WO2013/182366

PCT Pub. Date: Dec. 12, 2013

(65) Prior Publication Data

US 2015/0152827 A1 Jun. 4, 2015

(30) Foreign Application Priority Data

Jun. 8, 2012 (FR) ..... 12 55351

(51) Int. Cl.
*F16K 31/06* (2006.01)
*F02M 63/00* (2006.01)
*F02M 63/02* (2006.01)

(52) U.S. Cl.
CPC ..... *F02M 63/0073* (2013.01); *F02M 63/0017* (2013.01); *F02M 63/0033* (2013.01); *F02M 63/025* (2013.01); *F02M 2200/07* (2013.01)

(58) Field of Classification Search
CPC ..... F16K 39/022; F16K 31/0693; F16K 31/0658; F02M 63/0078; F02M 63/0073; F02M 51/0664; F02M 51/0635; F02M 2200/07
USPC ..... 251/129.02, 129.07, 129.16
See application file for complete search history.

(56) References Cited

U.S. PATENT DOCUMENTS 2,930,404 A * 3/1960 Kowalski ..... F16K 27/0263 137/454.5
4,502,031 A * 2/1985 Ito ..... H01F 7/081 335/257

(Continued)

FOREIGN PATENT DOCUMENTS

EP 1 106 816 A2 6/2001
EP 1 748 240 A1 1/2007

(Continued)

OTHER PUBLICATIONS

International Search Report corresponding to PCT Application No. PCT/EP2013/059518, mailed Jun. 7, 2013 (German and English language document) (5 pages).

*Primary Examiner* — John K Fristoe, Jr.
*Assistant Examiner* — Seth W Mackay-Smith
(74) *Attorney, Agent, or Firm* — Maginot, Moore & Beck LLP

(57) ABSTRACT

A pressure control valve for a high-pressure accumulator of an injection device of an internal combustion engine, includes a magnetic actuator. The magnetic actuator has a magnetic core with contacting pins and a magnetic armature with an armature plate. The contacting pins pass through feedthroughs formed in the armature plate. The armature plate is hydraulically connected by a pressure equalization channel to a valve chamber connected to low pressure. The pressure equalization channel has an opening on the magnetic core end face which opens into the armature space. At least one of the feedthroughs forms a passage for the fuel through the armature plate for the pressure equalization. A residual air gap disk is arranged between the magnetic core and the armature plate. The residual air gap disk forms an additional feedthrough with a radial extension that extends in the direction of the opening.

8 Claims, 2 Drawing Sheets

(56) References Cited

U.S. PATENT DOCUMENTS 4,586,656 A * 5/1986 Wich ..... F02M 59/466 123/458
4,971,116 A * 11/1990 Suzuki ..... H01F 7/1638 137/625.65
5,004,440 A * 4/1991 Suzuki ..... G05D 16/2013 137/625.65
5,259,414 A * 11/1993 Suzuki ..... F15B 13/0402 137/625.65
5,476,079 A * 12/1995 Kanamori ..... F02M 59/466 123/458
5,636,615 A * 6/1997 Shorey ..... F02M 57/02 123/458
5,848,613 A * 12/1998 Sakaguchi ..... F15B 13/0402 137/625.65
5,939,811 A * 8/1999 Enomoto ..... H01F 7/081 239/585.1
6,674,351 B2 * 1/2004 Koch-Groeber ... F02M 63/0021 251/129.16
6,764,061 B2 * 7/2004 Haeberer ..... F02M 47/027 251/129.16
6,848,669 B2 * 2/2005 Makino ..... F02M 63/0019 251/129.15

FOREIGN PATENT DOCUMENTS

EP 2 333 298 A1 6/2011
FR 1161438 8/1958

* cited by examiner

PRESSURE CONTROL VALVE

This application is a 35 U.S.C. §371 National Stage Application of PCT/EP2013/059518, filed on May 7, 2013, which claims the benefit of priority to Serial No. FR 1255351, filed on Jun. 8, 2012 in France, the disclosures of which are incorporated herein by reference in their entirety.

BACKGROUND

The disclosure relates to a pressure regulating valve.

EP 2333298 A1 discloses a pressure regulating valve, wherein, when the internal combustion engine is at a standstill, the pressure regulating valve is open, that is to say a connection from the high-pressure accumulator into a low-pressure line is opened up by a closing element. For this purpose, the pressure regulating valve has a magnetic actuator with a magnet core and with a magnet armature, wherein the magnetic actuator is energized in order to close the closing element by virtue of a magnet armature adjusting the closing element into its valve seat. To open the closing element, a spring element is provided which moves the magnet armature in an opening direction counter to the magnet force of the magnetic actuator, whereby the closing element is lifted from the valve seat and a hydraulic return connection between the high-pressure accumulator and the low-pressure line is opened up. The magnet armature has an armature plate which is arranged in an armature chamber formed above the magnet core. In the magnet core there is received a magnet coil with dimensionally stable contact pins, wherein the contact pins point perpendicularly from the magnet core face surface in the direction of the armature chamber. For a continuation of the contact pins in a closure cover situated above the armature chamber, leadthroughs for the contact pins are formed in the armature plate.

In FR 116 14 38, it is proposed that the armature chamber be hydraulically connected, via a pressure equalization duct extending through the valve housing, to a valve chamber which is connected to low pressure. In order that the two face sides of the armature plate of the magnet armature are exposed to the same pressure, a bore with a sleeve inserted therein is additionally formed in the armature plate so as to be in alignment with the pressure equalization duct, said bore serving to form a continuation of the pressure equalization duct to that face side of the armature plate which is situated opposite the armature surface.

SUMMARY

The pressure regulating valve according to the disclosure has the advantage that, through the formation of a radial extension at the further leadthrough in the residual air gap disk, improved throughflow for pressure equalization purposes is realized. The further leadthrough in the residual air gap disk is simple to produce from a manufacturing aspect and does not entail any significant additional manufacturing costs in the production of the pressure regulating valve. The pressure equalization duct has the effect that pressure fluctuations in the return line do not have any effect on the magnet armature, and that damping of the magnet armature during the opening phase of the closing element is achieved.

Advantageous refinements of the pressure regulating valve can be realized by means of the features of the subclaims.

The radial extension forms, in the residual air gap disk, a flow duct which extends substantially from the opening of the pressure equalization duct to the leadthrough formed in the armature plate. The radial extension expediently covers the opening, such that the opening of the pressure equalization duct issues into the extension.

The radial extension expediently has a slot-shaped form. In a first embodiment, the slot form of the radial extension is implemented with a substantially uniform width, wherein the width of the slot is formed by the diameter of the further leadthrough. In a second embodiment, the slot form of the radial extension is implemented with a decreasing width, wherein, in the direction of the opening, the width decreases from the diameter of the further leadthrough to at least approximately the diameter of the opening.

To make the flow duct as short as possible, the opening of the pressure equalization duct is arranged as close as possible to the leadthrough. The opening expediently lies on a line which intersects the center of the residual air gap disk and the center of the further leadthrough.

BRIEF DESCRIPTION OF THE DRAWINGS

Exemplary embodiments of the disclosure are illustrated in the drawing and will be explained in more detail in the following description.

In the drawing.

DETAILED DESCRIPTION

Figure 1:
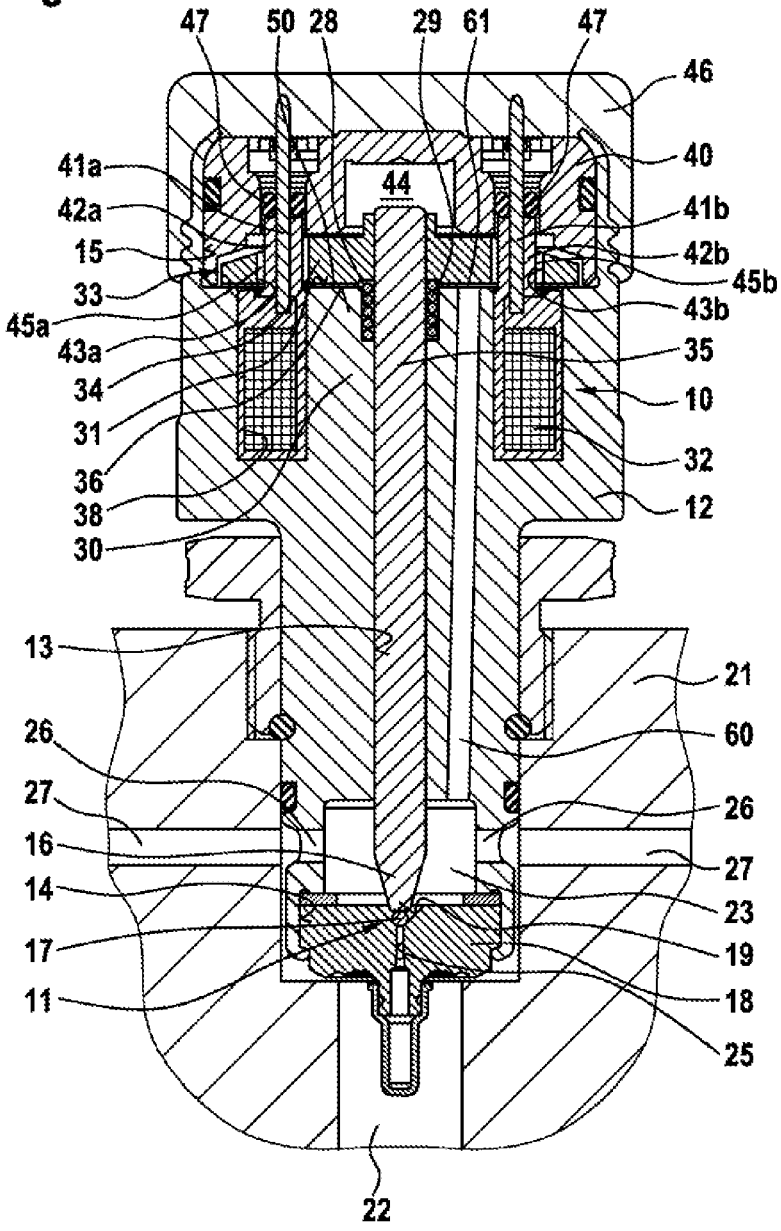
FIG. 1 is a sectional illustration through a pressure regulating valve.

The pressure regulating valve illustrated in FIG. 1 is inserted into a housing 21 of a high-pressure accumulator 22 of a fuel injection device of an internal combustion engine.

The pressure regulating valve has a magnetic actuator and a valve element 11, wherein the magnetic actuator 10 actuates the valve element 11. The magnetic actuator 10 is arranged in a valve housing 12 which has a piston guide 13, a valve piece receptacle 14 and a connector-side receptacle 15. The valve element 11 comprises a valve piston 16 with a closing element 17 in the form of a ball.

In the valve piece receptacle 14 there is formed a valve piece 18 which has a valve seat 19 for the closing element 17, wherein the closing element 17 acts on the valve seat 19. Via a spacer ring, the valve piece 18 delimits a valve chamber 23 into which there leads a throttle bore 25 which connects the valve chamber 23 to the high-pressure accumulator 22 when the closing element 17 is open. Two lateral hydraulic connections 26, for example, also issue into the valve chamber 23, which lateral hydraulic connections are connected to a low-pressure line 27, leading in turn to a return system.

The magnetic actuator 10 comprises a magnet core 30 with a magnet coil 32 and a magnet armature 33, wherein the magnet coil 32 acts on the magnet armature 33 via the magnet core 30. The magnet armature 33 has an armature plate 34 and an armature pin 35, wherein the armature pin 35 is fixedly connected to the armature plate 34. The armature pin 35 simultaneously forms the valve piston 16, such that the magnet armature 33 acts on the closing element 17 via the armature pin 35. The armature pin 35 is guided in axially displaceable fashion in the piston guide 13, wherein the piston guide 13 leads axially through the valve housing 12.

The magnet core 30 has, facing toward the armature plate 34, a magnet core face surface 31, also referred to as pole surface. On the armature plate 34 there is formed an armature surface 36, wherein the armature surface 36 forms the underside or the bottom side of the armature plate 34. Between the magnet core 30 and the armature plate 34 there is arranged a residual air gap disk 50. Also formed into the valve housing 12, at the magnet core face surface 31, is a spring chamber 28 in which there is arranged a compression spring 29 which acts on the magnet armature 33 in an opening direction.

A closure cover 40 is inserted in hydraulically sealed fashion in the connector-side receptacle 15. The closure cover 40 surrounds the armature plate 34 of the magnet armature 33 and forms an armature chamber 44 around the armature plate 34. The armature plate 34 is arranged in axially movable fashion in the armature chamber 44.

For electrical contacting, the magnet coil 30 is designed with a first dimensionally stable contact pin 41*a* and a second dimensionally stable contact pin 41*b*, said contact pins leading substantially perpendicularly out of the magnet core face surface 34 and each being surrounded by an insulating sleeve 42*a*, 42*b*.

The armature plate 32 has a first leadthrough 43*a* for a continuation of the first contact pin 41*a*, and has a second leadthrough 43*b* for a continuation of the second contact pin 41*b*. The leadthroughs 43*a*, 43*b* are designed such that a gap 45*a*, 45*b* is formed in each case between the insulating sleeves 42*a*, 42*b* and the leadthroughs 43*a*, 43*b*. The function of the gap 45*a*, 45*b* will be discussed further below. The contact pins 41*a*, 41*b* are guided by means of the insulating sleeves 42*a*, 42*b* in an electrically insulating encapsulation 46 which is arranged over the closure cover 40 and where the contact pins 41*a*, 41*b* are electrically contacted. In order for the contact pins 41*a*, 41*b* to be received in sealed fashion, they are each surrounded, at the face sides of the insulating sleeves 42*a*, 42*b*, by an O-ring 47 in the closure cover 40.

To form a pressure-balanced pressure regulating valve, the valve chamber 23 and the armature chamber 44 are hydraulically connected to one another via a pressure equalization duct 60. In this case, the pressure equalization duct 60 issues into the armature chamber at the magnet core face surface 31 by way of an opening 61.

In order that the pressure equalization in the armature chamber 44 acts both at the underside of the armature plate 43 and at the top side of the armature plate 34, the gaps 45*a*, 45*b* formed in the armature plate 34 between the insulating sleeves 42*a* and 42*b* and the leadthroughs 43*a*, 43*b* are utilized as passages for a throughflow of fuel for pressure equalization purposes. To increase the flow cross section for the passage, it is possible here for at least the leadthroughs 43*b* situated in the vicinity of the opening 61 to have a larger diameter or an extension.

Figure 2:
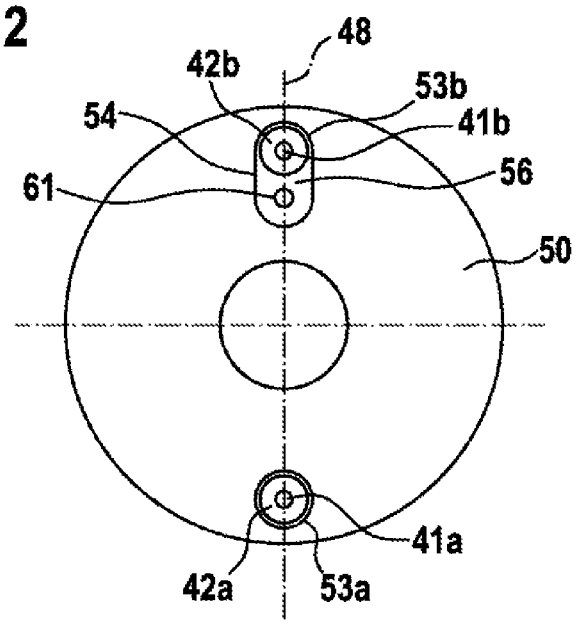
FIG. 2 shows a plan view of a residual air gap disk according to a first embodiment.
Figure 3:
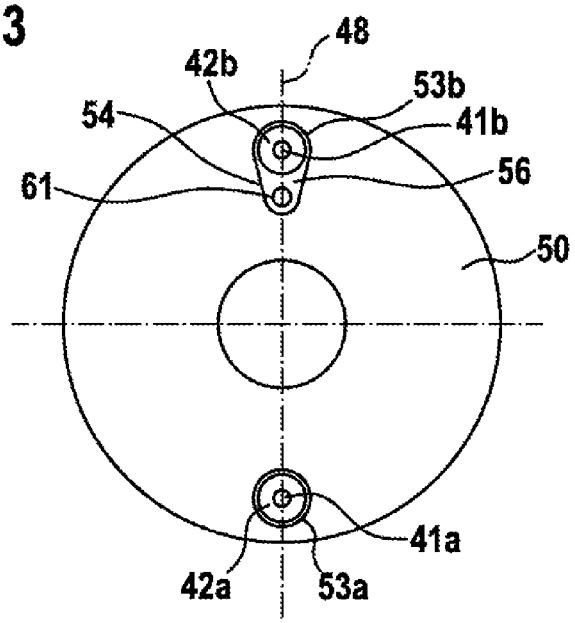
FIG. 3 shows a plan view of a residual air gap disk according to a second embodiment.

Correspondingly to the leadthroughs 43*a*, 43*b* in the armature plate 44, it is the case in FIGS. 2 and 3 that the residual air gap disk 50 arranged between the magnet core 30 and the armature plate 43 has further leadthroughs 53*a*, 53*b* for the leadthrough of the insulating sleeves 42*a*, 42*b*. At one of the two further leadthroughs 53*b*, which is situated in the vicinity of the opening 61, there is formed, for flow optimization purposes, a radial extension 54 extending in the direction of the opening 61. The radial extension 54 thus has, lying in the radial plane, a slot-shaped form which covers the opening 61, such that the opening 61 issues into the extension 54. As a result, from the opening 61 to the gap 45*a* at the leadthrough 43*b*, which substantially forms the passage for the fuel, there is formed a transversely running flow duct 56 which ensures that there is a hydraulic connection between the opening 61 and the gap 45*b*. It is not necessary here for the radial extension 54 to extend to the spring chamber 28.

The shortest possible radial extent of the flow duct 56 is attained if the opening 61 of the pressure equalization duct 60 is arranged in the vicinity of one of the leadthroughs 43*b*. For the simplest solution, the position is selected by virtue of the opening 61 being situated, as per FIGS. 2 and 3, in alignment with a line 48 which intersects the center of the residual air gap disk 50 and the center of the further leadthrough 53*b*. The proximity of the opening 61 to the insulating sleeve 42*a*, 42*b* is however limited because the pressure equalization duct 60 cannot be led through an annular magnet coil receptacle 38 in which the magnet coil 32 is cast with an insulating compound.

In the embodiment as per FIG. 2, the extension 54 is formed by a slot form with a uniform width, wherein the width of the slot is formed by the diameter of the further leadthrough 53*b*.

In the embodiment in FIG. 3, the extension 54 is formed by a slot formed with a width which decreases toward the opening 61 and which, in the direction of the opening 61, decreases from the diameter of the further leadthrough 53*b* to substantially the diameter of the opening 61.

The invention claimed is:

1. A pressure regulating valve for a high-pressure accumulator, comprising:

a magnetic actuator having a magnet core with contact pins and a magnet armature with an armature plate, wherein the contact pins projecting out of a magnet core face surface and extending through leadthroughs formed in the armature plate, wherein the armature plate being arranged movably in an armature chamber that is hydraulically connected via a pressure equalization duct to a valve chamber that is connected to low pressure; and a residual air gap disk arranged between the magnet core and armature plate, the residual air gap disk having further leadthroughs that correspond to the leadthroughs for the contact pins, wherein the pressure equalization duct has, on the magnet core face surface, an opening via which the pressure equalization duct issues into the armature chamber, wherein a passage for the fuel is configured, for pressure equalization, from one face side of the armature plate to the opposing face side of the armature plate, the passage being formed by at least one of the leadthroughs in the armature plate, and wherein the further leadthrough in the residual air gap disk that is situated in the vicinity of the opening has a radial extension extending in the direction of the opening.

2. The pressure regulating valve as claimed in claim 1, wherein the radial extension forms a flow duct that extends substantially from the opening to the leadthrough formed on the armature plate.

3. The pressure regulating valve as claimed in claim 1, wherein the radial extension covers the opening such that the opening issues into the radial extension.

4. The pressure regulating valve as claimed in claim 3, wherein the radial extension has a slot-shaped form with a substantially uniform width, and wherein the width of the slot form is formed by a diameter of the further leadthrough.

5. The pressure regulating valve as claimed in claim 3, wherein the radial extension has a slot-shaped form with a decreasing width, and wherein, in the direction of the opening, the width decreases from a diameter of the further leadthrough to at least approximately a diameter of the opening.

6. The pressure regulating valve as claimed in claim 1, wherein the opening of the pressure equalization duct is situated close to one of the leadthroughs.

7. The pressure regulating valve as claimed in claim 6, wherein the opening lies on a line that intersects the center of the residual air gap disk and the center of the further leadthrough.

8. The pressure regulating valve as claimed in claim 1, wherein the pressure regulating valve is configured for an injection device of an internal combustion engine.

* * * * *